United States Patent [19]

Fantuzzo et al.

[11] 4,027,964

[45] June 7, 1977

[54] APPARATUS FOR INTERPOSITION ENVIRONMENT

[75] Inventors: Joseph Fantuzzo, Webster; Robert M. Ferguson, Penfield; John W. Weigl, West Webster, all of N.Y.

[73] Assignee: Xerox Corporation, Stamford, Conn.

[22] Filed: July 25, 1974

[21] Appl. No.: 491,727

Related U.S. Application Data

[60] Division of Ser. No. 309,842, Nov. 27, 1972, which is a continuation-in-part of Ser. No. 104,386, Jan. 6, 1971, abandoned.

[52] U.S. Cl. ..... 355/10; 355/3 R

[51] Int. Cl.[2] ..... G03G 15/10

[58] Field of Search ..... 355/3 R, 3 DD, 10; 96/1 R, 1.4; 118/DIG. 23

[56] References Cited

UNITED STATES PATENTS

| | | | |
|---|---|---|---|
| 2,829,025 | 4/1958 | Clemens et al. | 355/3 R |
| 3,013,878 | 12/1961 | Dessauer | 96/1 R |
| 3,013,890 | 12/1961 | Bixby | 117/17.5 |
| 3,084,043 | 4/1963 | Gundlach | 96/1 R |
| 3,284,224 | 11/1966 | Lehmann | 355/3 DD |
| 3,697,160 | 10/1972 | Clark | 355/3 BE |
| 3,703,376 | 11/1972 | Gundlach et al. | 355/3 BE |
| 3,820,985 | 6/1974 | Gaynor et al. | 355/3 R |

*Primary Examiner*—R. L. Moses

[57] ABSTRACT

An electrostatographic imaging method employing polar liquid development comprising developing an electrostatic charge pattern present on an electrostatographic imaging surface by first contacting said imaging surface with a thin dielectric web, developing said electrostatic latent image on said interposed dielectric web with a polar liquid developer and transferring said developer from said dielectric film to a receiver sheet in image configuration.

2 Claims, 5 Drawing Figures

APPARATUS FOR INTERPOSITION ENVIRONMENT

This application is a division of application Ser. No. 309,842, filed Nov. 27, 1972 which is a continuation-in-part of application Ser. No. 104,386 filed Jan. 6, 1971 now abandoned.

This invention relates to imaging systems, and more particularly, to improved developer systems and techniques.

The formation and development of images on the surface of photoconductive materials by electrostatic means is well known. The basic electrostatographic process, as taught by C. F. Carlson in U.S. Pat. No. 2,297,691 involves placing a uniform electrostatic charge on a photoconductive insulating layer; exposing the layer to a light and shadow image to dissipate the charge on the areas of the layer exposed to the light and developing the resulting electrostatic latent image by depositing on the image a finely divided electrostatic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to a support surface as by heat. Instead of latent image formation by uniformly charging the photoconductive layer and then exposing the layer to a light and shadow image, one may form the latent image directly by charging the layer in image configuration. The powder image may be fixed to the photoconductive layer if elimination of the powder image transfer step is desired. Other suitable fixing means such as solvent or overcoating treatment may be substituted for the foregoing heat fixing step.

Similar methods are known for applying the electroscopic particles to the electrostatic latent image to be developed. Included within this group are the "cascade" development technique disclosed by E. N. Wise in U.S. Pat. No. 2,618,552; the "powder cloud" technique disclosed by C. F. Carlson in U.S. Pat. No. 2,221,776 and the "magnetic brush" process disclosed, for example, in U.S. Pat. No. 2,874,063.

Development of an electrostatic latent image may also be achieved with liquid rather than dry developer materials. In conventional liquid development, more commonly referred to as electrophoretic development, an insulating liquid vehicle having finely divided solid material dispersed therein contacts the imaging surface in both charged and uncharged areas. Under the influence of the electric field associated with the charged iamge pattern the suspended particles migrate toward the charged portions of the imaging surface separating out of the insulating liquid. This electrophoretic migration of charged particles results in the deposition of the charged particles on the imaging surface in image configuration. Electrophoretic development of an electrostatic latent image may, for example, be obtained by flowing the developer over the image bearing surface, by immersing the imaging surface in a pool of the developer or by presenting the liquid developer on a smooth surfaced roller and moving the roller against the imaging surface.

A further technique for developing electrostatic latent images is the liquid development process disclosed by R. W. Gundlach in U.S. Pat. No. 3,084,043 hereinafter referred to as polar liquid deveopment. In this method, an electrostatic latent image is developed or made visible by presenting to the imaging surface a liquid developer on the surface of a developer dispensing member having a plurality of raised portions or "lands" defining a substantially regular patterned surface and a plurality of portions depressed below the raised portions or "valleys". The depressed portions of the developer dispensing member contain a layer of conductive liquid developer which is maintained out of contact with the electrostatographic imaging surface. Development is achieved by moving the developer dispensing member loaded with liquid developer in the depressed portions into developing configuration with the imaging surface. The liquid developer is believed to be selectively attracted from the depressed portions of the applicator surface in areas where an electrostatic field exists. With the use of a conventional electrophotographic plate which has been uniformly charged and exposed to a light and shadow pattern, the charged or image areas are developed. The developer liquid may be pigmented or dyed. The development system disclosed in U.S. Pat. No. 3,084,043, differs from electrophoretic development systems where substantial contact between the liquid developer and both the charged and uncharged areas of an electrostatic latent image surface occurs. Unlike electrophoretic development systems, substantial contact between the polar liquid and the areas of the electrostatic latent image bearing surface not be developed is prevented in the polar liquid development technique. Reduced contact between a liquid developer and the nonimage areas of the surface to be developed is desirable because the formation of background deposits is thereby inhibited. Another characteristic which distinguishes the polar liquid development techniques from electrophoretic development is the fact that the liquid phase of a polar developer actually takes part and physically moves during the development in response to the elecrostatic field. The liquid phase in electrophoretic developers functions only as a carrier medium for developer particles.

In copending application of Alan A. Amidon, Joseph Mammino and Robert M. Ferguson, Ser. No. 839,801, filed July 1, 1969 abandoned, now Ser. No. 219,883, filed Jan. 21, 1972, and entitled Imaging Systems, a technique is disclosed wherein an electrostatic latent image is developed by placing the imaging surface adjacent a patterned applicator surface having a substantially uniform distribution of raised portions or lands and depressed portions or valleys and containing a relatively nonconductive liquid developer in the depressed portions of the applicator. Relatively nonconductive liquid developers having a resistivity of up to about $10^{14}$ ohm-cm are surprisingly attracted from the depressed portions of the applicator to areas where an electrostatic field exists without any substantial electrophoretic separation of particles from the liquid.

While capable of producing satisfactory images, these liquid development systems in general, suffer deficiencies in certain areas and are in need of further development and improvement. Particularly troublesome difficulties are encountered in liquid development systems employing reusable or cycling electrostatographic imaging surfaces which are generally preferred imaging surfaces in automatic copying machines because of the increased speed of copying, the reduced cost per copy and the ability to produce a final print of consistent high quality on ordinary paper. In these systems, an imaging surface such as for example, a selenium drum type photoconductor is charged, exposed to a light and shadow pattern and developed by bringing the image bearing surface into development engagement with an applicator containing the liquid developer. The developer is transferred from the applicator to the imaging surface according to the appropriate development technique and thereafter, the developer pattern is transferred from the imaging surface to a receiving surface such as paper. During the transfer step, not all the liquid developer is transferred from the imaging surface. In order to recycle the imaging surface, the residual developer remaining on the surface following transfer must be either removed or its effects immobilized. Otherwise, it will tend to be present as background in subsequent cycles and tend to degrade subsequent charging and exposing steps in subsequent cycles. In addition, with a liquid developer which is relatively conductive having, for instance, a resistivity less than about $10^{10}$ ohm-cm any residue remaining on the imaging surface may dissipate any charge subsequently applied. Furthermore, lateral conductivity of the liquid developer on the imaging surface may become excessive and the resolution of the resulting image will be poor. In addition, on repeated cycling, there is a progressive accumulation of liquid developer on the imaging surface since in each cycle, not all the developer is transferred to the receiving sheet. This progressive accumulation of developer residue will quickly result in an overall loss of density, deterioration of fine detail and increased background deposits on the final copy since accurate imaging on the imaging surface is inhibited.

Additional difficulties are present in electrophoretic development systems employing cycling or reusable imaging surfaces in that the charged marking particles separate from the carrier liquid and migrate to the charged or image portions of the imaging surface. These particles strongly adhere to the imaging surface by means of Van der Waals forces since they frequently come within about 500 angstroms of the imaging surface. The Van der Waals forces are so strong that in the subsequent transfer step, a considerable portion of the particles remain on the imaging surface, thus producing prints of relatively low density and contributing to background depositions in subsequent cycles.

Procedures to remove liquid developer from the surface of reusable imaging surfaces have been proposed. However, to provide the necessary removal of the developer film, the cleaning step must be so severe and complete that there may be a progressive degradation of the imaging surface lessening its useful lifespan. The severity of the cleaning step is dictated by the fact that in most presently used methods of cleaning a liquid from a surface, the film is progressively split so that on each separate cleaning, a significant portion of the liquid remains on the photoconductor surface. The cleaning solvents generally necessary to provide adequate cleaning frequently are major contributors to the chemical attack of the imaging surface and are frequently hazardous due to their volatility and toxicity. In some instances, and with complete removal of the ink film, the electrical properties of a photoconductor, for example, are virtually destroyed by the cleaning operation after only a small number of cycles. In other instances, the cleaning solvents employed may act as solvents for the resin in a binder plate or may induce crystallization of the thin layer of selenium. Thus, electrostatographic imaging systems employing reusable imaging members require a compromise between the presence of residual liquid developer on the imaging surface and the force necessary to remove sufficient developer without degradation of the imaging surface. Furthermore, in many of the previously proposed imaging systems employing reusable imaging surfaces, the cleaning mechanism becomes very sophistiated requiring close adjustments and tolerances between moving members and the application of cleaning materials in rather specified quantites. The close control necessary increases the complexity of the entire imaging system and contributes to an additional maintenance burden. In addition, some imaging surfaces may be excessively rough or porous resulting in nonuniformity of contact with the developer applicator during development. It is therefore clear that there is a continuing need for an improved electrostatographic imaging system employing a reusable or cycling imaging surface.

SUMMARY OF THE INVENTION

It is therefore an object of this invention to provide an electrostatographic imaging system which overcomes the above noted deficiencies.

It is another object of this invention to provide a surface to be developed which does not have the undesirable properties of the image bearing surface.

It is another object of this invention to provide a smooth uniform surface upon which to develop an electrostatic charge pattern.

It is another object of this invention to provide a surface to be developed having improved liquid developer receptivity and release properties.

It is another object of this invention to provide an imaging system employing liquid development of an electrostatic latent image on a recycling or reusable electrostatographic imaging surface.

It is another object of the present invention to provide an electrostatographic imaging system employing liquid development wherein a reusable or cycling electrostatographic imaging surface does not have to be cleaned on each imaging cycle.

It is another object of this invention to provide an electrostatographic imaging system employing liquid development wherein a plurality of final copies may be obtained without the necessity of separately forming the electrostatic latent image on the reusable imaging surface for each copy.

The above objects and others are accomplished generally speaking, by providing an electrostatographic imaging system employing polar liquid development wherein prior to development, a thin dielectric film or web is interposed between the electrostatographic imaging surface and the polar liquid developer dispensing member to provide development of the electrostatic latent image on the interposed film. Following development, the film bearing the liquid developer in image configuration is contacted with a developer receiver surface and the liquid developer transferred thereto in image configuration.

More specifically, final prints of high resolution and image density may be obtained on ordinary paper, for example, in a polar liquid development system wherein development of an electrostatic charge pattern present on a reusable electrostatographic imaging surface is achieved on the side of a single use film or reusable belt of dielectric material opposite that side which is in substantially uniform contact with the imaging surface. To achieve this recycling capability with a liquid development technqiue which provides high quality prints, the film may be interposed at any time prior to development and should remain in contact with the electrostatographic imaging surface until the developer present on the side of the interposed film opposite that in contact with the imaging surface is transferred to a receiving surface in image configuration. Alternatively, the developed film may be removed from the electrostatographic imaging surface and the developed images present on the film may be carried to a remote transfer station and there transferred to a receiving surface in image configuration. The film is preferably interposed or placed in substantially uniform line contact with the imaging surface in such a manner that it is not subjected to a charging operation and maintained in substantially uniform contact during development. Image preservation of the electrostatic charge pattern on the imaging surface may be achieved in the liquid development system of this invention after development by separating the dielectric film or belt from the imaging surface without any substantial transfer of charge from the imaging surface to the dielectric film or belt. This is achieved by insuring that during separation, the potential across the space or gap between the imaging surface and interposed film is less than that necessary to cause air breakdown within the gap and consequently transfer of charge from the imaging surface to the interposed film.

The invention may be further illustrated by reference to the accompanying drawings in which.

Figure 1:
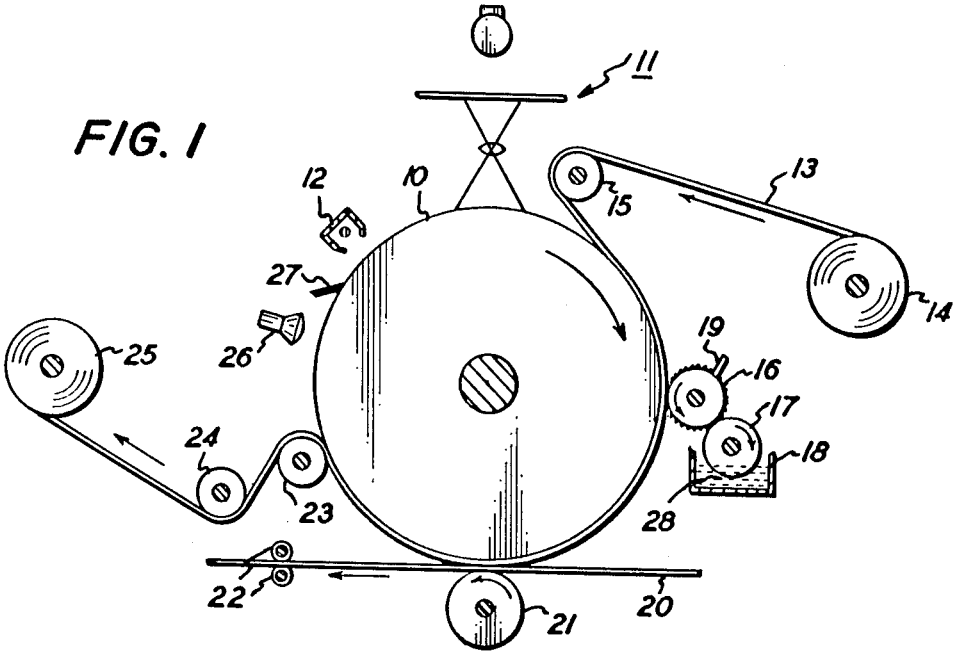
FIG. 1 is a schematic view of an embodiment of an electrostatographic imaging system employing the development technique of the present invention.

In the electrostatographic imaging system depicted in FIG. 1, an electrostatic latent image is placed on the imaging surface, here illustrated as a rotating cylindrically mounted from photoconductor 10 such as a selenium drum, by uniformly placing a positive charge on the drum by charging means 12 and exposing the charged imaging surface to a light and shadow pattern through exposure means 11. A thin film of dielectric material 13, such as polypropylene is fed from supply roll 14 past positioning and tensioning roll 15 to provide a substantially uniform area contact of the dielectric film 13 with the surface of the photoconductor 10 substantially completely along the path from tensioning roll 15 to tensioning and separating roll 23. The dielectric film 13 should be present on the surface of the photoconductor as a smooth film as completely free of air bubbles and ripples as possible. Development of electrostatic latent image is accomplished with a rotating patterned applicator roller 16 loaded with a liquid developer 28 by means of feed roller 17 and doctored by doctor blade 19 to provide liquid developer in the depressed portions of the applicator surface while the raised portions are substantially free of developer. The liquid developer may be replenished through the developer reservoir 18 by any suitable means such as gravity from a developer bath which is not depicted. The developer on the interposed layer in image configuration is transferred to a receiver sheet such as ordinary paper 20, held in pressure contact with the dielectric film by means of transfer roller 21. The receiver sheet is moved through the transfer zone in contact with the interposed film at the same rate and in the same direction as the periphery of the drum. If desired, transfer may be electrostatically assisted. The receiver sheet bearing the developer in image configuration is thereafter fed through copy feed out rolls 22. The dielectric film remains in contact with the photoconductor to a point following the transfer station and is finally separated from the photoconductor by conductive separation roller 23 and passes around roller 24 with the used film being wound up on takeup roller 25. The charged image pattern on the photoconductor may be dissipated by blanket illumination from lamp 26 to render the photoconductor ready for the next imaging cycle.

The interposed dielectric film may be kept in substantially uniform contact without the formation of ripples or air bubbles by any suitable means. It may, for example, be fed at precisely the same rate as the periphery of the photoconductor through the development transfer and separating operations. Typically, the speed of the dielectric film may be maintained equal to that of the photoconductor surface merely by wrapping the film around the periphery of the photoconductor and maintaining the film in light pressure contact with the photoconductor. It is preferred that the dielectric film be brought into virtually complete uniform contact with the photoreceptor so that there are no ripples or air bubbles between the film and the photoreceptor in order to inhibit the distortion of developer on the dielectric film during development and to insure development of all the image areas. To this end, it is generally preferred to provide a wiper blade device such as wiper blade 27 to scrape any particulate matter such as dust from the surface of the photoconductor on a cyclical basis. It may also be desirable to employ a flexible backing roller, not shown enabling the positioning of the thin dielectric film over the surface in spite of surface discontinuities to insure the intimate contact between the film and the developer dispensing member. In addition, the transfer receiver sheet should preferably be fed into the transfer nip between the dielectric film and the transfer roller 21 at the same peripheral speed as the dielectric film to minimize distortion due to spreading of the liquid developer.

Figure 2:
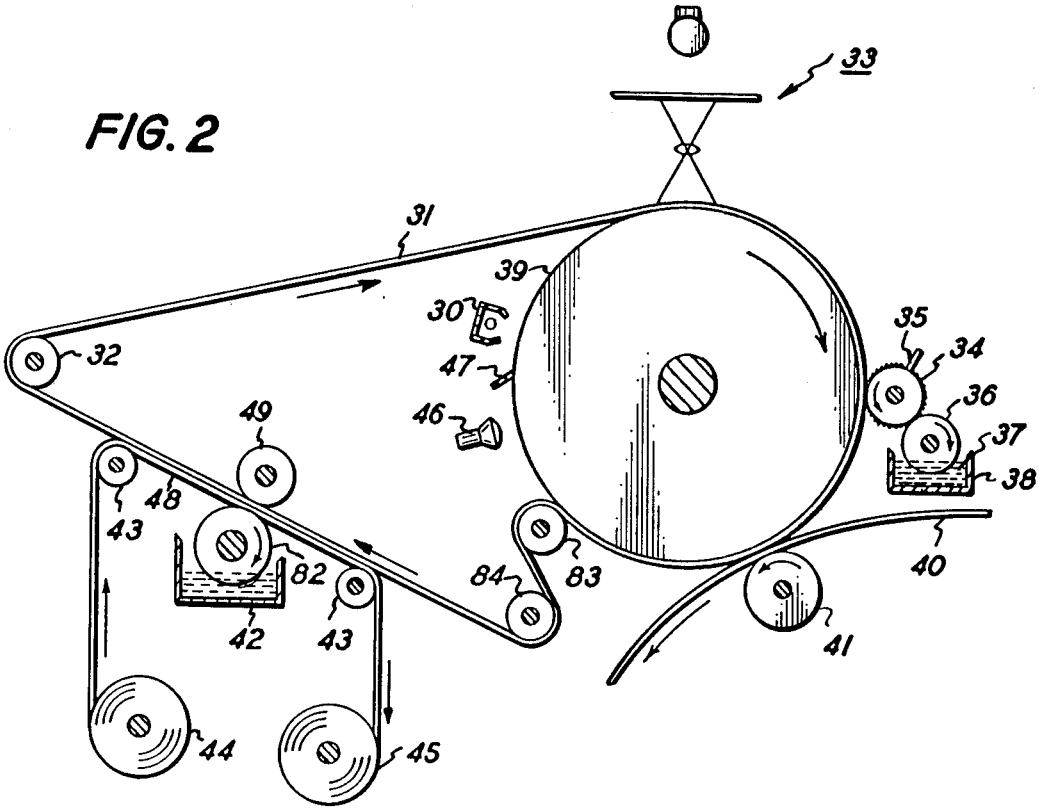
FIG. 2 is a schematic view of an electrostatographic imaging system employing an alternative technique for interposing a belt of a dielectric material.

In the alternative electrostatographic imaging system depicted in FIG. 2, a belt of dielectric material 31 is positioned to contact a substantial portion of photoconductive drum 39 by tensioning roller 32. The dielectric belt 31 is driven to provide substantially uniform contact with the photoconductor drum throughout the exposure, development and transfer operations. The photoconductor drum 39 is uniformly charged by charging means 30 and exposed to a light and shadow pattern by exposure means 33. Development of the electrostatic latent images is accomplished on the interposed belt 31 by patterned applicator roller 35 which is loaded with liquid developer 37 by means of feed roller 36 and doctor blade 35 to provide liquid developer in the depressed portions of the applicator surface while the raised portions are substantially free of developer. The liquid developer present on the interposed dielectric belt 31 is transferred to a receiving surface such as ordinary paper through transfer roller 41 wherein the receiving paper is moved at the same speed and in contact with the dielectric film. The dielectric belt may be separated from the drum by separation rollers 83 and 84. Any residual developer remaining on the interposed reusable belt of dielectric material may be cleaned from that belt by any suitable technique. In this figure, the cleaning station comprises cleaning web 48 fed in a direction countercurrent to the direction of movement of the dielectric belt from feed roll 44 to takeup roll 45 around positioning members 43. One side of cleaning belt 48 is in wiping contact with the dielectric belt while the opposite side is in contact with a cleaning fluid source, such as porous roller 82 rotating in a bath of cleaning fluid 42. Contact between the dielectric belt and the cleaning web is maintained substantially uniform by pressure roller 49. Cleaning web 48 may be any suitable porous material capable of transmitting liquid from one side through the belt to the other side to provide the desired wiping contact on the dielectric belt. For further details of the specific cleaning technique depicted here, reference is made to copending application Ser. No. 886,633, entitled Imaging System, filed Dec. 19, 1969 by Robert M. Ferguson and Richard J. Komp. Following transfer of the developer from the interposed dielectric belt to the receiving member 40 and separation of the dielectric belt from the surface of the photoconductor, any residual charge pattern remaining on the photoconductor may be dissipated by blanket illumination from lamp 46. Any particulate matter accumulating on the surface of the photoconductor may be removed by wiper blade 47 to insure that substantially uniform contact between the dielectric belt and the photoconductor during the imaging, development and transfer operations is obtained.

Figure 3:
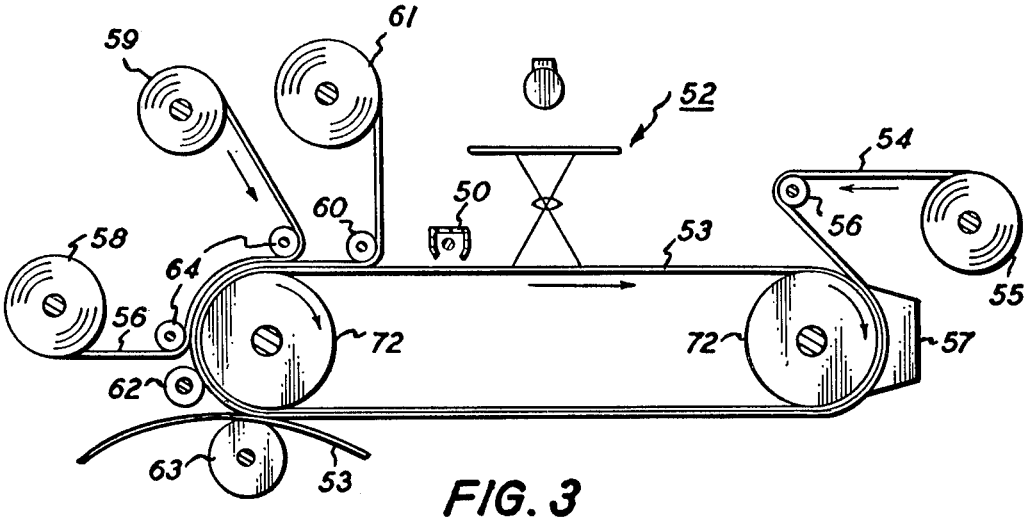
FIG. 3 is a schematic view of an electrostatographic imaging system employing an alternative means for interposing a dielectric film.

FIG. 3 illustrates an alternative embodiment of the invention in which the imaging surface comprises a web or sheet like material 53 such as for example, a layer of photoconductive particles such as phthalocyanine in an insulating resin overcoated onto a seamless web of conductive material. The photoconductive insulating layer is uniformly charged by charging means 50, exposed to a light and shadow pattern at exposure station 52. A reusable dielectric web material 54 is interposed and maintained in contact with the photoconductive layer around a substantial portion of the belt surface by means of positioning rollers 56 and 60. The dielectric web is fed from feed supply roll 55 past positioning roller 56 to provide a substantially uniform area contact between the dielectric belt and the photoconductive surface. Development of the electrostatic latent image formed on the photoconductive surface prior to contact with the dielectric web may be accomplished at polar liquid development station 57 in the same manner as described in FIGS. 1 and 2. The photoconductive belt is moved sequentially past the various imaging sections by means of positioning and transport rollers 72 which may be synchronously driven by any suitable means not shown. After formation of the image pattern on the interposed dielectric web, transfer of the developer in image configuration to receiver sheet 53 is accomplished by passing sheet 53 in contact with the interposed dielectric web by means of positioning roller 63. Thereafter, the surface of the dielectric web is passed through a cleaning station here illustrated as comprising a rotatable roller 62 impregnated with a cleaning aid which is subsequently uniformly distributed and wiped from the interposed dielectric web by wiping web 56 moving in a direction countercurrent to the advancing direction of the dielectric web from feed roll 59 past positioning rollers 64 to takeup roll 58. After cleaning the used dielectric web may be taken up onto takeup roll 61 and if desired, the web may be removed, rewound onto feed roll 55 and reused.

Figure 4:
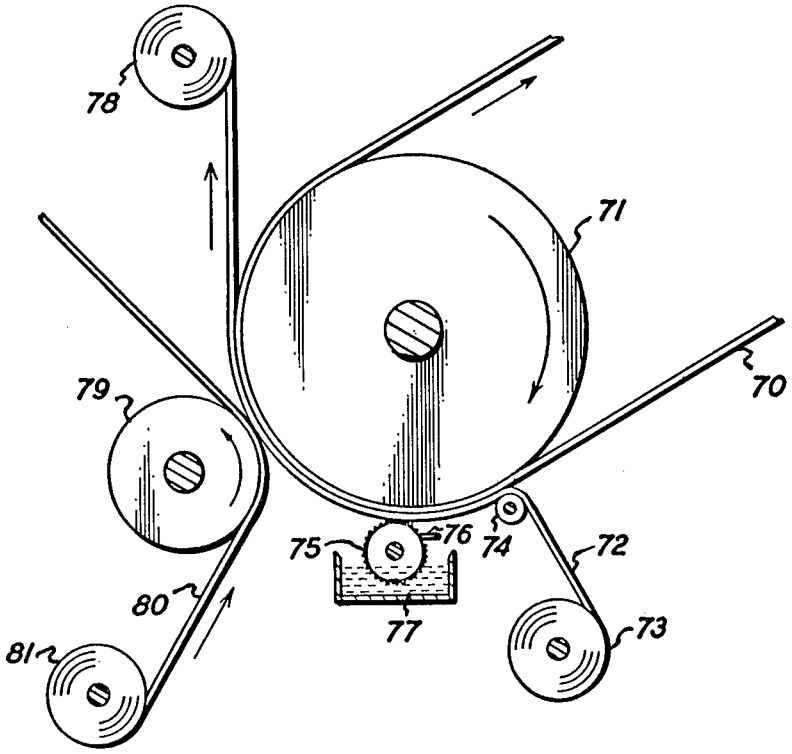
FIG. 4 is a schematic view of an electrostatographic imaging system employing an alternative means for interposing and separating the dielectric film.

FIG. 4 illustrates an alternative embodiment in which imaging surface 70 bearing an electrostatic latent image previously formed is passed around support roller 71 in contact with dielectric web 72, fed from supply roll 73 and collected by means of takeup roll 78. Uniform contact may be achieved by positioning roller 74. Development of the electrostatic latent image on the interposed dielectric film is achieved in the manner described in FIGS. 1 and 2 with applicator roller 75 partially immersed in bath 77 of liquid developer, the surface of the applicator being doctored by doctor blade 76. The developer is transferred to a receiver sheet 80 fed from supply roll 81 by means of transfer roller 79 which places the transfer sheet and dielectric web in contact. As seen from these illustrative embodiments, the techniques of this invention permit unusually great flexibility in design.

Figure 5:
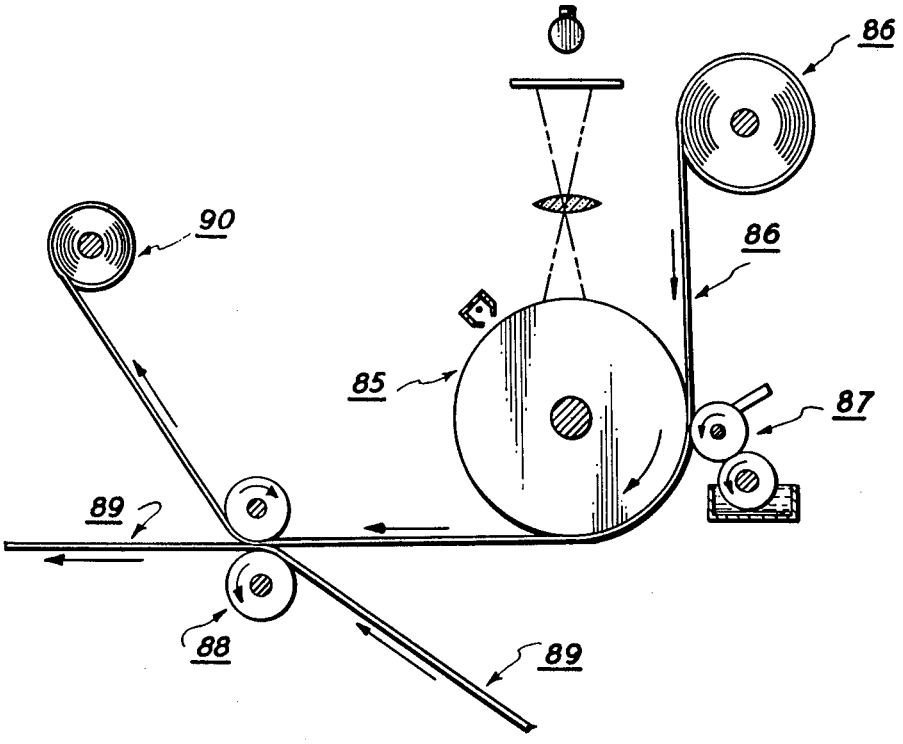
FIG. 5 is a schematic view of an electrostatographic imaging system employing an alternative means for transfer of the image to a receiving surface.

FIG. 5 illustrates an alternative embodiment of the invention in which the image containing web is stripped from the photoconductive drum and transfer occurs at a remote station. An electrostatic latent image is placed on the imaging surface 85 by conventional means previously described. A thin film of dielectric material 86 is brought into substantial contact with the photoconductive drum 85 and development occurs as heretofore described at the developer station depicted as 87. The image-bearing dielectric material is stripped away from the photoconductive drum and follows a path to a remote transfer station 88 where the developer in image configuration is transferred to a receiver sheet 89. The dielectric film is then wound on takeup roller 90.

Any suitable electrostatographic imaging surface may be employed in the practice of this invention. Basically, any surface upon which an electrostatic charge pattern may be formed and maintained for a short period time may be employed. Typical electrostatographic imaging surfaces include dielectrics such as plastic coated papers, image patterns of insulating materials on conductive substrates and photoconductors. Typical photoreceptors include photoconductive materials on an electrically conductive support member such as brass, aluminum, nickel, steel or the like. The support member may be of any convenient thickness and may be in any desired form such as a sheet, web, plate, cylinder, drum or the like. It may also comprise other materials such as metalized paper and plastic coated sheets. Typical photoconductive materials that may be employed include selenium and selenium alloys; cadmium sulfide, cadmium sulfoselenide, phthalocyanine binder coatings and polyvinyl carbazole sensitized with 2,4,7-trinitrofluoronone.

The electrostatic charge pattern may be formed on the electrostatographic imaging surface in any suitable manner. A dielectric layer may, for example, be charged in image configuration by positioning the layer adjacent to a pattern or array of high voltage energized pin electrodes. When a photoconductive insulating material is employed as the imaging member, the electrostatic latent image may be formed by the conventional steps of uniformly charging the photoconductive insulating layer in the dark and exposing the layer to a light and shadow pattern to form a charge pattern in image areas only.

While the electrostatic charge pattern on a photoconductive insulating layer may be formed with the dielectric film or web in contact with the layer as by charging and exposure therethrough, it is preferred to charge the photoconductive insulating layer prior to contact with the interposed dielectric film or web. This enables the placement of the charge on the photoconductive insulating layer rather than on the interposed dielectric layer and facilitates the dissipation of charge in background area upon exposure to the light and shadow pattern. Otherwise, with a uniform charge present on the interposed dielectric film during the exposure cycle, a considerable residual charge in the background areas will remain since the interposed dielectric film is generally sensitive to light. Furthermore, when employing a reusable dielectric film, if a charge remains on the dielectric film, additional means must be supplied to dissipate or neutralize this charge prior to the next imaging sequence. While it is generally preferred for these reasons to charge the photoconductor prior to the interposition of the dielectric film, exposure to the light and shadow pattern may occur either before or after the film is interposed if desired. However, when exposure is through the interposed film, the film should be transparent so that light may strike the photoconductor and dissipate the charge in the background areas.

As previously discussed, it is highly preferred to provide a substantially uniform area contact between the dielectric film and the imaging surface and to initiate this contact with a substantially uniform line contact when the film is initially placed adjacent to the imaging surface and to maintain this substantially uniform contact without air bubbles or ripples along the entire portion of contact between the imaging surface and the interposed film. A complete uniform contact is highly desired to minimize the occurrence of air bubbles and ripples in the interposed film. If air bubbles or ripples are present, they may be compressed into the depressed portions of the developer applicator during development and contact the liquid in this area to form background deposits on the film. In general, therefore, discontinuities in the path between the photoconductor and a dielectric material can be tolerated with satisfactory imaging results to only a limited degree. Furthermore, the presence of fine particulate matter on the imaging surface may have the same effect as air bubbles and ripples.

The dielectric film or web may be interposed between the electrostatographic imaging surface and the developer applicator member in any suitable manner. It is generally preferred, however, to place the imaging surface and the dielectric film or belt in contact prior to development to insure substantially uniform contact between the imaging surface and the interposed dielectric web and thereby provide better development of the image areas. Such contact may be supplied, for example, by passing the interposed film between the imaging surface and a web feeding roller which effectively forms a nip and squeezes substantially all the air back out of the nip.

Since the imaging surface bears either a uniform charge or a charge in image configuration, transfer of this charge to the interposed dielectric film due to air breakdown when placing the imaging surface and the dielectric film contact should be avoided if there is a tendency for this to occur. This may be accomplished in any suitable manner. Typically, it is desirable that the positioning member which presses the interposed film into contact with the imaging surface be subtantially nonconductive so as not to present a ground plane behind the film and to avoid glow discharge between the charged portion of the incoming imaging surface and the interposed film as they approach the contact nip. In the absence of a grounded or conductive backing roller, no field is present across the air gap between the imaging surface and the dielectric film and there is therefore no danger of starting glow discharge and the charge on the imaging surface remains undisturbed and undiminished. Once the substantially uniform contact between the interposed dielectric film and the imaging surface is formed at the interposing nip, this type of close contact is maintained for all portions of the imaging surface and film in contact. Alternatively, the film may be maintained in pressure contact with the imaging surface by any suitable means. The interposed film should be advanced at a rate which is substantially the same as the advancing rate of the imaging surface during the several stages in which the dielectric film and the imaging surface are in contact to thereby avoid any possible distortion of the image during the development step or thereafter. This substantially uniform contact and synchronized advancement of interposed film and imaging surface may be accomplished in any suitable manner. Typically, it is achieved merely by wrapping the film around an arcuate portion of the imaging surface under tension so that the pressure between the dielectric film and the imaging surface pulls the film from its supply reel.

Any suitable dielectric material may be employed as the interposed film or web in the practice of this invention. Typically, the interposed film should have sufficient tensile strength and dimensional stability to enable it to be readily interposed and maintained in uniform contact with the imaging surface and adequate resistivity and dielectric strength to enable development on one side of the interposed film in response to an electrostatic charge pattern present on the surface contacting the opposite side of the film. To provide the necessary mechanical properties and to maintain the film in contact with the imaging surface without distortion of the film, it is generally preferred that the film have a tensile strength greater than about 4000 pounds per square inch and that the percent elongation of the film be very small. Typically, the films are nonporous and from about 3 microns to about 75 microns in thickness. Three microns is generally the lower limit due to the general inability to mechanically handle thinner films. The upper limit of about 75 microns is generally the thickness through which development may take place without significant loss of resolution. At a film thickness of about 75 microns, the resolution may be limited to about 5 to 6 line pairs per millimeter. In addition, the voltage applied to the imaging surface to induce developer transfer from the developer dispensing member generally increases with the thickness of the interposed film. For film thickness greater than about 75 microns, for example, voltages greater than about 1000 volts may be necessary. On the other hand, with increasing dielectric film thickness the handling of the film during the interposition, development, transfer and separating operations is more readily facilitated.

Optimum balance between mechanical handling of the film and deterioration of image resolution is generally achieved with films having a thickness of from about 5 to about 65 microns. Preferably we employ films having a thickness from about 6 to about 25 microns. The interposed films typically have volume resistivities greater than about $10^{10}$ ohm-cm to insure that when placed in contact with the charged imaging surface, the charge is not dissipated by lateral conduction through the interposed film. Typically the interposed films have dielectric constants greater than about 2.2. Since the capacitance is proportional to the ratio of the dielectric constant to film thickness in order to provide the necessary capacitance for the thicker dielectric materials as compared to thinner materials of relatively low dielectric constant, the dielectric constant of the thicker materials should generally be greater. In order to insure freedom from interference or influence by static surface charges on the dielectric film, it is generally preferred that the film either be treated with a static remover or have a static surface charge density of less than about $10^{-8}$ coulombs per square centimeter.

Typically, the dielectric film may comprise of a single layer or multiple layers of one material on top of another. Typical specific unitary film materials include extruded or drawn polyolefin films such as polyethylene, polypropylene, and polybutene; elastomers including oil resistant neoprene, silicone elastomers and fluoroelastomers such as the copolymer of vinylidene fluoride and hexafluoropropylene available from E. I. duPont de Nemours and Company under the tradename Viton. In addition, cast films of cellulose acetate, polystyrene; extruded films, polyethylene terephthalate as well as films of polyvinyl fluoride, polytetrafluoreethylene and cellophane may be employed. Composite dielectric materials may also be employed and are particularly useful when the film is to be reused. For this purpose, barium titanate dielectric composites in which the barium titanate serves to greatly enhance the dielectric constant to values of 25 to 30 are particularly useful. In addition, double layer laminated or coated films in which one component provides one property and the other component provides a second property may be employed. For example, a double layer film comprising a polyethylene terephthalate base to provide good tensile strength and a surface coating of polyvinyl chloride providing good cleanability may be employed. While all of the above mentioned materials may be employed as the interposed film, for single use of disposable films, it is generally preferred to employ polyolefins since these materials are readily and economically available and can provide superior antistatic and strength properties. Particularly superior imaging results are obtained with the use of biaxially oriented polypropylene since it has a high dielectric constant compared to the unoriented materials and superior tensile strength when compared to other polyolefins. The interposed dielectric film may be opaque unless exposure of the imaging surface is to be through the film in which case it should be transparent. When employing a reusable interposed web or film, it is generally preferred to provide one with sufficient thickness to withstand the necessary continuous mechanical handling of the film since the thicker materials produce the greater rigidity, durability, stiffness and ease in handling. Accordingly when employing the film as a reusable web film of the order of from about 12 to about 65 microns are preferred. A particularly superior film of this thickness when employed as a reusable interposed web is a film made of polyvinyl fluoride such as Tedlar which has high dielectric constant of from about 8.5 to 9.2, allows quick charge dissipation because of its relatively low bulk resistivity, is relatively easy to clean and is stable under long term use.

After the electrostatic latent image has been formed on the imaging surface and the dielectric film or web positioned adjacent to the imaging surface in substantially uniform continuous contact, development of the electrostatic latent image present on the imaging surface is achieved on the interposed film. The mechanism of development employed may be substantially the same as that in the polar liquid development technique described by R. W. Gundlach in U.S. Pat. No. 3,084,043. In this technique the liquid developer is applied to a patterned applicator such that the raised portions of the applicator surface are substantially free of developer and the level of the liquid in the recessed portions of the applicator is slightly below the level of the lands. Surface tension retains the developer in cohesive configuration in the depressed portions of the applicator surface and as the raised portions of the applicator surface are placed in light or gentle contact with the interposed layer, the liquid developer in response to electrostatic field of force on the imaging surface is guided up the sides of the depressed portions of the applicator surface and then an attached bead of developer deposits on the imaging surface substantially only in accordance with the pattern of electric charge. The developer remains in the depressed portions of the applicator surface except in those portions which are under the influence of the attracting electrostatic force. A principal advantage of this development technique is the ability to develop both positive and negative charge patterns with the same developer since the polar liquid developers have the ability of having charge of both polarities induced in them with substantially equal ability. Alternatively, the developer may be brought into very close proximity to the latent image on a smooth roller or other donor surface. The developer may then be attracted to the image areas as an attached bead and deposits on the web or film in image formation. Care must be exercised to see that the developer does not generally contact the image-bearing member.

Any suitable developer dispensing member may be employed. It may take the form of a roller for example, having a smooth or patterned surface or may be in the form of an endless web or belt having a smooth or patterned surface. Porous ceramic materials and metallic sponge may also be used as the applicator device. The principal characteristics in the patterned surface form include preferably that the structure should be substantially uniform or regular in configuration having raised portions or lands and depressed portions or valleys and that it be capable of holding developer material in the depressed portions of the pattern. A particularly effective applicator device providing uniform development is a cylindrical roll having a patterned surface which may be of a trihelicoid, pyramidal, single thread or quadragravure grooved pattern.

During development, the developer dispensing member which is generally conductive may be biased or directly connected to ground through connection to a variable DC potential source so that the liquid developer will be electrostatically attracted from the applicator to the imaging surface in image configuration. When so biased, the charges on the imaging surface induce equal and opposite charges in the liquid developer. For example, when the applicator is grounded and the imaging surface bears a positive charge pattern negative charge is induced in the liquid developer opposite the positive charges and the developer moves toward the imaging surface in response to the electrostatic field between these charges. Portions of the imaging surface carrying no charge induce no charge in the developer and thus, the developer is not pulled out of the recessed portions of the applicator surface to non-field areas of the image surface. Development is readily achieved in this manner if the field between the imaging surface and the developer dispensing member is sufficient to attract the developer out of the recessed portions. It is desirable, however, to avoid excessive voltages and thus avoid air breakdown between the interposed dielectric film and the developer dispensing member. Polar liquid development is capable of very high speed development of the order of up to 200 inches per second. The speed of development in the improved systems of this invention is limited only by the rate of developer flow in response to the applied field and the ability to mechanically handle the thin dielectric web.

Reversal development may be obtained by applying to the developer applicator a potential sufficiently close to that of the charged areas on the imaging surface to drop the field in these areas below the development threshold. Typically, this may be accomplished by applying to the developer applicator a potential of the same polarity and about the same magnitude as in the charged areas of the imaging surface. This serves to cancel out the field at charged areas and provide an electrostatic field between the uncharged areas of the imaging surface and the developer on the applicator surface. Countercharge is induced in the developer in response to the electrostatic field as described above but now the developer is drawn out of the recessed portions of the applicator surface onto the film overlying areas of the imaging surface which are uncharged.

Any suitable liquid developer may be employed in the practice of this invention. Typically, the developers which are effective have a conductivity of from about $10^{-4}$ ohm-cm$^{-1}$ to about $10^{-14}$ ohm-cm$^{-1}$ and comprise colorants dispersed or dissolved in liquid vehicles. Typical vehicles within this group providing these properties include water, methanol, ethanol, propanol, glycerol, ethylene glycol, propylene glycol, 2,5-hexane diol, mineral oil, the vegetable oils including castor oil, peanut oil, sunflower seed oil, corn oil and rapeseed oil. Also included are silicone oil, mineral spirits, halogenated hydrocarbons such as Dupont's Freon solvents and Krytox oils; esters such as fatty acid esters, kerosene and oleic acid. Any suitable colorant may be employed including both dyes and pigments. Typical pigments include carbon black and other forms of finely divided carbon, quinacridones, iron oxides, zinc oxides, titanium dioxide, and benzidene yellow. In addition, as is well known in the art, the developers may contain one or more secondary vehicles, dispersants, viscosity controlling additives, or additives which contribute to fixing the developer on the copy paper.

Following development of the electrostatic latent image by depositing liquid developer on the interposed dielectric film only in the charged or image portions, the dielectric film and the imaging surface may either be maintained in substantially uniform continuous contact until after transfer of the developer in image configuration to a receiving surface has been accomplished or it may be separated and transfer accomplished at a location remote from the imaging surface. If the dielectric is stripped or separated from the imaging surface prior to transfers, reasonable care may be necessary to avoid undesirable charge transfer due to air breakdown between the imaging surface and the dielectric film. The liquid developer may be transferred to any suitable image receiving member flexible or rigid, absorbent or nonabsorbent. Typically, any surface upon which the liquid developer may be placed in image configuration may be employed. Typical well known materials include paper, cardboard and plastic sheets, films or laminates.

Any suitable technique of transferring the liquid developer in image configuration from the interposed dielectric web to the receiving surface may be employed. Typically, the developed image-bearing dielectric film is passed in rolling contact with the receiving surface on the side bearing the developer in image configuration and the liquid developer is pressure transferred to the receiving surface such as paper. Typically, the pressure employed in such transfer is from about 0.5 to about 5 pounds per linear inch. However, any other suitable transfer technique may be employed. For example, a biasing electrode may be applied behind the necessary surface to provide electrostatic field assistance for the transfer. The dielectric film bearing the liquid developer in image configuration and the receiving sheet may be maintained in contact over a period of time. However, care should be employed to avoid physical distortion of the image that may occur as a result of prolonged contact.

Transfer of the electrostatic charge pattern from the imaging surface to the interposed dielectric film as a result of air breakdown is also to be avoided when operating the imaging technique of this invention in the image preservation mode. In this mode of operation, a plurality of prints may be made from a single image merely by repeated development and transfer steps without the necessity of the separate image formation steps for each print. According to this invention, if loss of the image on the imaging surface can be avoided during any development and transfer cycle and if there has been little or no transfer of charge when the film is placed in contact with the imaging surface, the image retained on the imaging surface may be redeveloped on an additional area of interposed dielectric film to provide a plurality of copies while employing only a single image forming sequence. The number of development sequences available depends only on the rate of dark decay of the imaging surface. One method to avoid transfer of the charge pattern if this is a problem when separating the dielectric film from the imaging surface, is to wrap the dielectric film around a backup roll, such as roll 23 illustrated in FIG. 1 in such a manner that the potential difference between the photoconductor and the backup roll is maintained below that level required to permit electrostatic charge to cross the space between the imaging surface and the dielectric film. Transfer of an electrostatic charge from the imaging surface to the dielectric layer occurs when the air between the imaging surface and the dielectric layer is ionized as a result of the large potential across the gap. According to Paschen's law, the breakdown potential is a linear function of the gas pressure times the distance between the electrodes. Thus, for air, at atmospheric pressure, the minimum breakdown voltage is about 360 volts. As the distance between the dielectric film and the imaging surface increases from about 8 microns the breakdown voltage also increases. Thus, to avoid breakdown, it is necessary only to insure that the voltage is less than that required for breakdown across air or a specified spacing as is shown from the Paschen curve. This may be accomplished in any suitable manner. Typically, it is accomplished by providing a conductive surface at the nip where the dielectric film is separated from the imaging surface and assuring that this conductive matter is either grounded or has a bias potential applied to it of sufficient magnitude to prevent breakdown across the space between the interposed film and imaging surface. Typically this conductive member may be in the form of a roller around which the dielectric film is wrapped when being separated from the imaging surface.

When employing an interposed dielectric film in the form a reusable web member, it is desired to cyclically clean any residual liquid developer from the interposed film. Cleaning or removal of this residual developer may be accomplished in any suitable manner. Typically, the residual liquid developer may be cleaned from the imaging surface by contacting the imaging surface with a cleaning liquid which is miscible with the liquid developer and removing the liquid developer by contacting it with an absorbent fibrous material such as disclosed in application Ser. No. 886,633 filed Dec. 19, 1969 by Robert M. Ferguson and Richard J. Komp, now U.S. Pat. No. 3,725,059 in application Ser. No. 886,634, filed Dec. 19, 1969 by Richard J. Komp. The interposed dielectric film may also be cyclically cleaned by contacting the imaging surface with a small quantity of a highly absorbent dry powder as disclosed in application Ser. No. 873,103, filed Oct. 31, 1969 by Joseph Mammino, now U.S. Pat. No. 3,697,263. The particular cleaning technique which may be employed may be readily determined by one skilled in the art.

DESCRIPTION OF PREFERRED EMBODIMENTS

The following preferred examples further define, describe and compare preferred materials, methods and techniques of the present invention. Example III, IV and V are presented for comparative purposes. In th examples, all parts and percentages are by weight unless otherwise specified.

EXAMPLE I

A development system similar in configuration to that depicted in FIG. 1 is assembled with about a four and three quarter inch diameter electrophotographic drum comprising a conductive substrate overcoated with about a 50 micron thick layer of vacuum deposited selenium. A transparent biaxially oriented polypropylene film about 6 microns in thickness is wrapped around about half the drum. The liquid developer employed has a volume resistivity of about $5 \times 10^{10}$ ohm-cm and is of the following composition by weight:

| | |
|---|---|
| Light paraffin oil | 60 parts by weight |
| Ganex V-216 | 10 parts by weight |
| Microlith CT Black | 30 parts by weight |

Ganex V-216 is an alkylated polyvinyl pyrrolidone compound available from GAF. Microlith CT Black is a resinated predispersed carbon black pigment composed of about 33 percent by weight carbon black pigment and about 67 percent by weight ester gum available from CIBA. The developer is loaded onto a cylindrical applicator roll having a trihelicoid pattern of about 180 lines per inch and doctored to provide ridges on the applicator surface which are substantially free of liquid while the grooves are filled with liquid to a level slightly below the level of the ridges. The photoconductor is uniformly charged positively in the dark to about 800 volts and is exposed to a light and shadow pattern and thereafter contacted with the polypropylene film such that the film is wrapped around a portion of the drum with a minimum of trapped air bubbles or ripples. The trihelicoid roller loaded with liquid developer is brought into very light contact, about one pound per lineal inch, with the film as it passes the development station and the liquid developer is deposited on the dielectric film in a pattern corresponding to the charged image areas on the photoconductor. Thereafter, while maintaining the polypropylene film in uniform contact with the photoconductor, the developer on the polypropylene film is transferred to bond paper by moving the paper through a nip formed between the polypropylene film and a rubber roller under a pressure of about one pound per lineal inch. The print on the bond paper has a resolution of about seven line pairs per millimeter, image density of 1.0 amnd 0.02 background. The interposed polypropylene film is discarded by winding it up on a cylindrical roll. This imaging system is run for about 8000 cycles with substantially no change in print quality.

EXAMPLE II

The procedure of Example I is repeated in substantially every material detail except that the developed system used similar in configuration to that depicted in FIG. 5. After development wherein liquid developer deposited on the dielectric film in a pattern corresponding to the charged image areas on the photoconductor, the dielectric film stripped away and the developed image thereon transferred to bond paper at a remote transfer station located twelve inches from the photoconductor. The print quality found to be acceptable.

EXAMPLE III

The procedure of Example I is repeated with an electrophoretic liquid developer containing negatively charged toner particles. The developer is of the following composition:

| | |
|---|---|
| Xylene | 172 parts by weight |
| Duraplex D-65A | 100 parts by weight |
| Neo Spectra Mark I | 100 parts by weight |

Duraplex D-65A is an oil modified alkyd resin available from Rohm & Haas Company. Neo Spectra Mark I is a carbon black pigment available from Columbian Carbon Company, Incorporated. Development and transfer are accomplished in the same manner as in Example I except that the trihelicoid roller is replaced by a smooth surface roller rotating in uniform contact with the film and the doctor blade is removed. The final copy on bond paper after transfer has resolution of nine line pairs per millimeter, image density of 0.25 and 0.05 background. On examination of the polypropylene film, after transfer and comparison with a film after transfer employed in Example I, considerably more particulate matter is observed to remain on the film of Example II. The very low image density renders these prints unacceptable.

EXAMPLE IV

The procedure of Example I is repeated except that after development of the electrostatic latent image on the polypropylene film and prior to the developer being transferred to bond paper, the film is separated from the photoconductor by taking it off on a straight path coinciding approximately to the tangent at the point of parting from the drum. The developed image on bond paper has a resolution of about five line pairs per millimeter compared to the seven line pairs per millimeter obtained in Example I, image density of 1.0 and 0.02 background.

EXAMPLE V

The procedure of Example I is repeated except that the photoconductor is charged and exposed while the polypropylene film is in uniform contact with it. Development and transfer are accomplished in the same manner as described in Example I. The print on bond paper has about seven line pairs per millimeter resolution, 1.0 image density and 0.15 background compared to the very low background of Example I.

EXAMPLE VI

An imaging system similar in configuration to that depicted in FIG. 1 is assembled with a transparent polyethylene film about 25 microns in thickness wrapped around a portion of the drum. The photoconductor is charged in the dark to about 750 volts and exposed to a light and shadow pattern. The electrostatic latent image is developed with a developer having a resisitivity of about $10^{10}$ ohm-cm and of the following composition:

| | |
|---|---|
| Light paraffin oil | 47 parts by weight |
| Ganex V-216 | 22 parts by weight |
| Microlith CT Black | 31 parts by weight |

The developer is loaded onto a cylindrical roll having a trihelicoid pattern of about 180 lines per inch and doctored to provide ridges on the applicator surface which are substantially free of liquid developer while the grooves are almost completely filled to the level of the ridges. The trihelicoid roller loaded with the developer is brought into light contact with the interposed polyethylene film as it passes the developement station and the developer is deposited on the dielectric film in a pattern corresponding to the charged image areas. The developer on the polyethylene film is transferred to bond paper by moving the paper through a nip formed between the polyethylene film and a 50 Shore A durometer urethane elastomeric roller under a pressure of about 2 pounds per lineal inch. Thereafter, the polyethylene film is separated from the photoconductor by being wrapped around a one inch diameter electrically grounded metal roll and discarded by winding it up on a takeup roll. The print on the bond paper has a resolution of about 4.5 line pairs per millimeter and image density of 0.98 and 0.02 background. The eletrostatic latent image present on the photoconductor is recycled and developement is again obtained in the same manner on an interposed film of polyethylene for an additional 100 cycles. The eightieth print has a resolution of about four line pairs per millimeter, 0.85 image density, 0.02 background.

EXAMPLE VII

The procedure of Example I is repeated except that the interposed dielectric material is 25 micron cellulose acetate. Development is obtained in the same manner as in Example I and with the developer described in Example VI. Transfer of the developer from the interposed cellulose acetate film is obtained by moving the film while in contact with the photoconductor and bond paper through a nip formed between the film and a roller under a pressure of about 0.5 pounds per lineal inch. The print on the bond paper has a resolution of about four line pairs per millimeter, image density of 0.98 and 0.05 background.

EXAMPLE VIII

The procedure of Example VII is repeated except that the dielectric film is a laminated film of equal thickness of polyethylene and polyethylene terephthalate having a total thickness of about 30 microns. Development is obtained on the polyethylene side of the film. The print obtained on bond paper has a resolution of about four line pairs per millimeter, image density of 1.02 and 0.05 background.

As seen from the foregoing description and the preferred and comparitive examples, the development techniques and systems according to the present invention provide improved electrostatographic imaging systems employing a liquid development technique with a reusable or cycling imaging surface. The technique is capable of providing copies on ordinary paper of fine detail and high quality.

Although specific materials and operational techniques are set forth in the above exemplary embodiments, using the imaging system of this invention, these are merely intended as illustrations of the present invention. There are other materials, techniques and systems than those listed above which may be substituted with similar results. Other modifications of the present invention will occur to those skilled in the art upon a reading of the present disclosure which modifications are intended to be included within the scope of this invention.

What is claimed is:

1. Electrostatographic imaging apparatus comprising a path defining imaging surface and sequentially positioned with relationship to said path, means to form an electrostatic charge pattern on said imaging surface, means to substantially uniformly contact and maintain said contact with said imaging surface with a thin dielectric film, means to apply a polar liquid developer to the interposed thin dielectric film in image configuration in response to the electrostatic charge pattern on the imaging surface, conductive means to separate said thin dielectric film from said imaging surface with substantially no transfer of charge from said imaging surface to said thin dielectric film and means to transfer said liquid developer from said thin dielectric film to an image receiving surface.

2. Apparatus according to claim 1 further including means to discharge said imaging surface after separation of said dielectric film.

* * * * *